United States Patent [19]

Delaney

[11] 4,074,647

[45] Feb. 21, 1978

[54] SAILING RIG HAVING CAMBER ADJUSTMENTS

[76] Inventor: Richard D. Delaney, 12 Parkview Drive, Conneaut, Ohio 44030

[21] Appl. No.: 703,414

[22] Filed: July 8, 1976

[51] Int. Cl.[2] ..... B63H 9/04

[52] U.S. Cl. ..... 114/102; 114/39; 114/90; 114/98

[58] Field of Search ..... 114/39, 102, 103, 90, 114/97, 98

[56] References Cited

U.S. PATENT DOCUMENTS

| | | | |
|---|---|---|---|
| 2,561,253 | 7/1951 | Wells-Coates | 114/102 |
| 3,112,725 | 12/1963 | Malrose | 114/90 |
| 3,173,395 | 3/1965 | Laurent | 114/102 X |
| 3,272,167 | 9/1966 | Monfreid | 114/102 |
| 3,656,444 | 4/1972 | Kratz | 114/102 X |

FOREIGN PATENT DOCUMENTS

| | | | |
|---|---|---|---|
| 847,310 | 9/1960 | United Kingdom | 114/102 |

*Primary Examiner*—Stephen G. Kunin
*Assistant Examiner*—Sherman D. Basinger
*Attorney, Agent, or Firm*—Charles L. Lovercheck

[57] ABSTRACT

A sailing rig having camber adjustments is disclosed. The rig includes a mast that is sharply cambered adjacent its base and pivoted to a vehicle, and a boom pivoted to the center pivot of the mast. The sail may be connected to the mast by a continuous bead on the edge of the sail which is received in a slot in the mast and slides between two halyards that are connected to the sail and pass through the tubular mast, one on each side of the slot.

8 Claims, 12 Drawing Figures

SAILING RIG HAVING CAMBER ADJUSTMENTS

GENERAL DESCRIPTION OF THE INVENTION

This invention relates to improving the driving force for a sailing rig by boundary layer control achieved through the use of a device which provides sail camber adjustment. Numerous devices, such as leading edge and trailing edge flaps, have been effective in maintaining laminar flow in the boundary layer over airplane wings. These devices prevent separation of the boundary layer and formation of a wake when the angle of attack is moved well beyond that which normally would cause a wake to form. The final result is greatly increased lift, with minimal increase in drag. Without these devices an airplane beyond the critical angle of attack would lose all lift and forward motion, causing the airplane, inevitably, to stall.

REFERENCE TO PRIOR ART

The following patents show various types of curved masts, but none of them show masts by which the camber of the sail can be controlled: U.S. Pat. Nos. 3,272,167; 3,340,841; 3,656,444; 3,768,426 and British Pat. No. 1,010,090.

OBJECTS OF THE INVENTION

It is an object of the invention to provide a system which will offer boundary layer control for sail boats in a manner similar to what has been done in airplanes.

Another object of the invention is to provide a rotating mast, sharply cambered near its base, and tapering in a more gentle curve head toward the mast head, with a boom hinged to the pivot point of the mast.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWING

Figure 1:
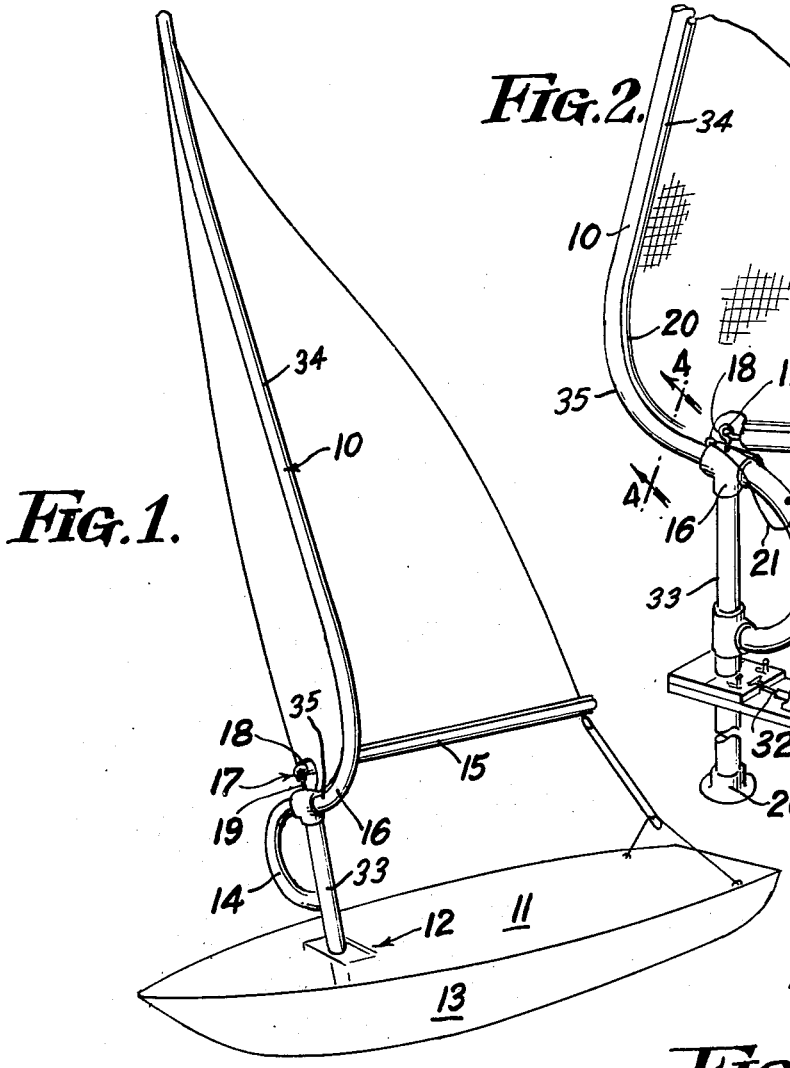
FIG. 1 is an isometric view of a sailing boat with the mast according to the invention thereon.
Figure 2:
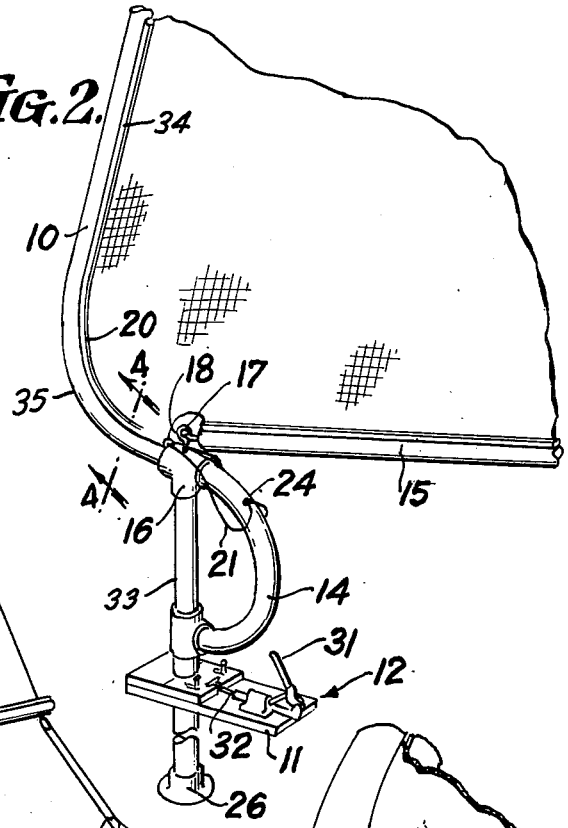
FIG. 2 is an enlarged partial view of the mast and sail shown in FIG. 1.

Now, with more particular reference to the drawing, in FIGS. 1–12 a camber mast system is shown. The mast pole 10 has a straight, lower part 33 and a forwardly extending part 35 connected to it. The forwardly extending part 35 curves upwardly at 16 and terminates at the upper end 34. The lower straight part 33 forms a pivot axis. Mast 10 is rotatably supported in bearing 26 and is secured against rotation on a deck 11 below deck and, when handle 31 is swung back, the pin and clamp 32 are pulled back and thus the locking device is released. The mast is free to revolve in a housing and bearing 26 is fastened to the hull 13. The mast may be moved to a position in the wind by releasing the toggle clamp 12, moving the mast with the handle 14, and then locking the mast in place in its new position by engaging the toggle-like locking clamp 12.

In the example shown, the boom 15 is fastened at a point on the axis of rotation 16 of the mast. The boom is hinged to the assembly by rigging ring connectors 17 made up of eyelet 18 connected to the boom 15 and eyelet 19 connected to the pivot axis of the mast. The eyes of eyelets 17 and 18 are interlinked with each other so that they form a hinge. Since the eyelets are interlinked, they act as a universal hinge allowing the boom to have some vertical movement, as well as to swing in a horizontal plane. This allows freedom of movement of the boom in all directions.

The sail fastens to and is raised up the mast in the longitudinal groove or channel 20, either external or internal to the mast, in a manner that is familiar to those skilled in the art. Bead 25 may be molded to the edge of the sail or luff along its entire edge.

Figure 3:
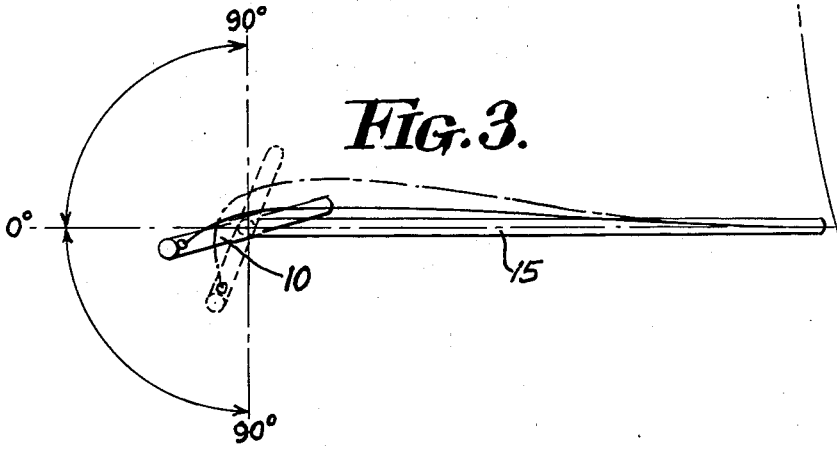
FIG. 3 is a top view of the mast and sail showing the camber adjustment by mast rotation.
Figure 4:
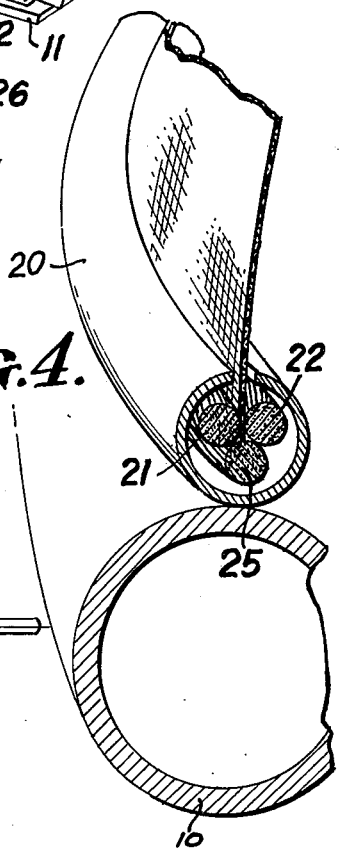
FIG. 4 is a cross-sectional view taken on line 4—4 of FIG. 2.
Figure 5:
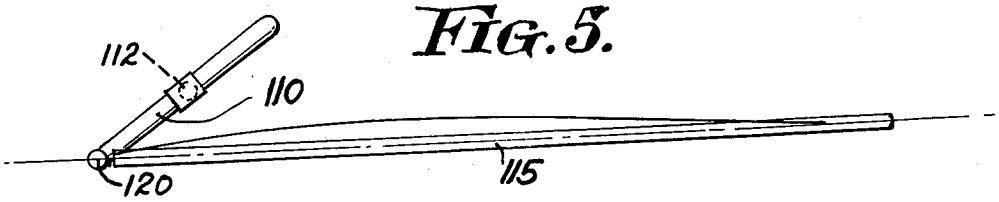
FIG. 5 is a view showing the boom hinged at point of maximum mast camber.

It is the object of this invention to devise a system which will offer boundary layer control for sail boats in a similar manner as has been done for airplanes. This object was accomplished in this invention (FIG. 1) which comprises a rotating mast, sharply cambered near the base, tapering in a more gentle curve towards the masthead, and with a boom hinged behind the point of maximum mast camber. A spar system so designed permits continuous adjustment of sail camber (draft) over a wide range extending from an essentially flat, draftless sail to a highly cambered sail. Where the conventional method provides a fixed camber sewn into the sail, the cambered-mast system gives a method for continuous camber adjustment and can be accomplished with a flat, uncut sail. The degree of sail camber is varied by rotating the mast in a 180° arc from 90° on the starboard side, past straight ahead, to 90° on the port side (FIG. 3). The sail camber is flat (zero) when the mast is aligned straight ahead with the boom and full sail camber results in either of the 90° positions to the boom for either port or starboard tacks. The point of maximum sail camber is determined by the point where the boom is fastened to the assembly in relation to the camber of the mast (FIGS. 5–8). In order to achieve any camber at all the boom must be fastened to the rear of or behind the point of maximum mast camber otherwise camber in the sail cannot be developed unless it is achieved conventionally by tailoring. It is an embodiment of this invention that the point of maximum sail camber be varied, also, by selective positioning of the point where the boom fastens to the assembly over a lateral range of from one inch behind the point of maximum mast camber to one-half the length of the sail foot (FIGS. 5–8). The embodiment of the invention shown in FIG. 5 shows the boom 115 pivoted to the point of maximum mast camber at 120.

Figure 6:
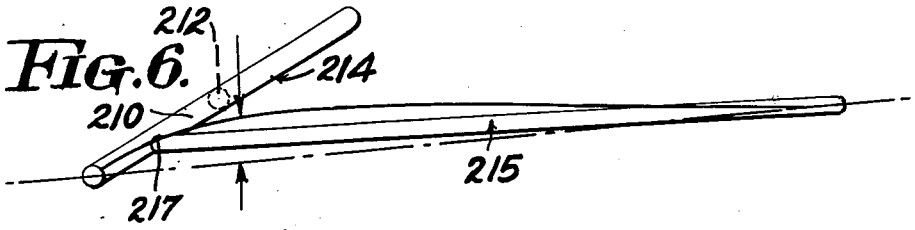
FIG. 6 is a view of the boom hinged midway between mast foot and maximum camber point of mast.

In the embodiment of the invention shown in FIG. 6, the boom 215 is hinged at 217 to the mast midway between the mast foot and the point of maximum camber of the mast.

Figure 7:
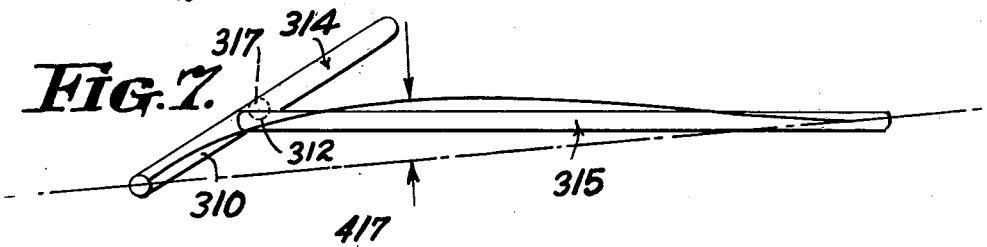
FIG. 7 is a view showing the boom hinged at mast foot.

In the embodiment of the invention shown in FIG. 7, the boom 315 is shown hinged to the mast 310 at the mast foot at 317.

Figure 8:
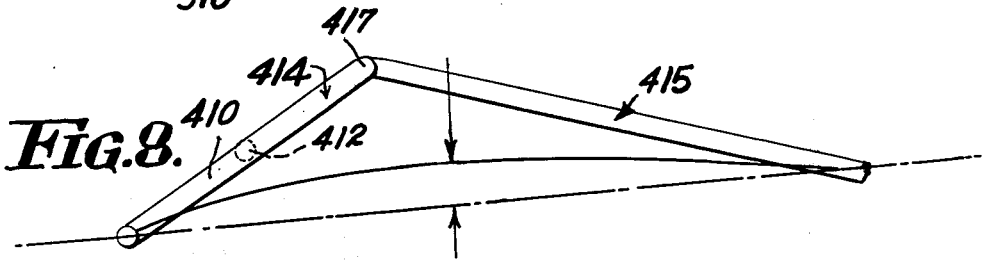
FIG. 8 is a view of the boom hinged midway along sail foot.

In the embodiment of the invention shown in FIG. 8, the boom 415, which has a part 414 fixed to the mast and hinged to the second rear part 415 at 417, is shown. The masts 110, 210, 310 and 410 are pivoted to the boats at 112, 212, 312 and 412, respectively, in the manner shown in FIGS. 1 and 2.

Figure 9:
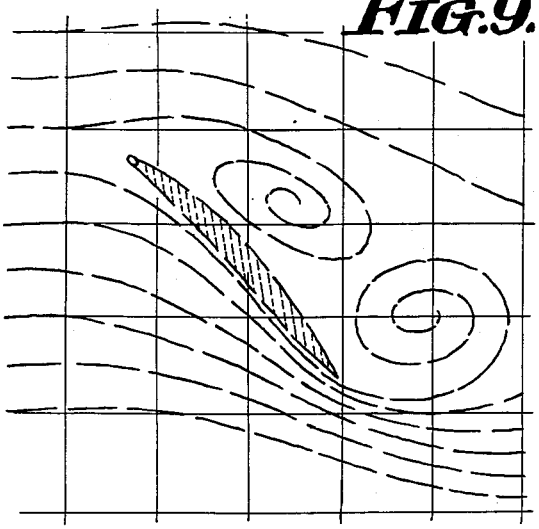
FIG. 9 is a view showing the air flow path around a conventional sail.
Figure 10:
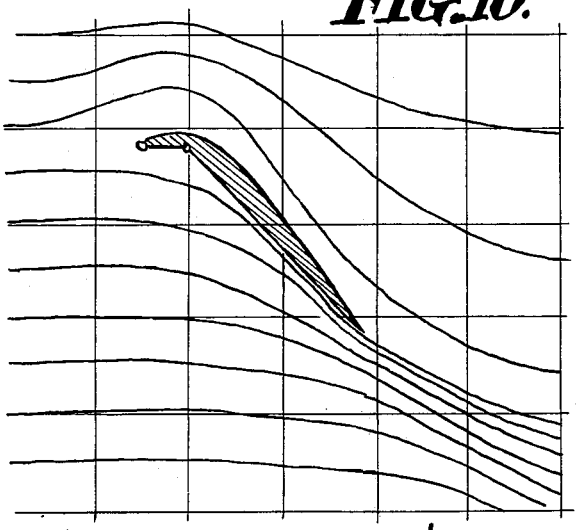
FIG. 10 is a view of the air path around the camber sail accoring to the invention.
Figure 11:
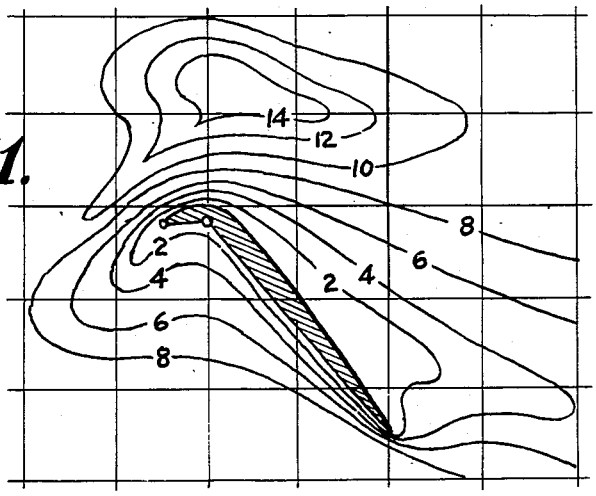
FIG. 11 is a view of the air velocity contours, around the camber sail.
Figure 12:
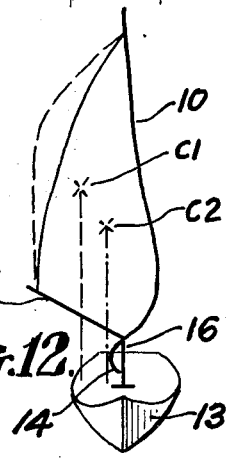
FIG. 12 is a front view of the sail showing the center of effort of a conventional mast and of the camber mast.

FIGS. 9–11 show how a cambered mast with the boom hinged to the rear of maximum camber produces a sail shape or camber which at a high angle attack duplicates the camber of an airplane wing equipped with boundary layer control devices. The streamlines of FIGS. 9 and 10, and the velocity contours of FIG. 11 were plotted and drawn from velocity vectors which were measured and plotted from actual wind tunnel tests.

Wind tunnel tests have shown that vortices do not appear behind the sail of a cambered mast system as described in this invention until the angle of attack reaches 45°. The appearance of vortices behind the sail are an indication that boundary layer separation has occurred. In comparison with the conventional spar systems this represents a marked improvement. The conventional system with an uncut sail (zero camber) showed separation or loss of laminar flow beginning at a 28° angle of attack, and the fixed-camber sail (fixed at 0.05 camber--expressed as percent of chord), lost laminar flow at 33° angle of attack.

The improved air flow characteristics described above for a cambered mast system over a conventional spar system are reflected in actual power measurements made from wind tunnel tests. The tests were made at a wind velocity of 10 miles an hour with sail models mounted on a truck which traversed a track adjustable to all wind headings. Force measurements were made with an Ohaus triple beam balance located beneath the tunnel and connected to the truck by a cable and pulley system. Driving and heeling forces were measureed in grams and converted to grams/cm$^2$ on the basis of model sail area. Sail areas were first approximated by template measurement and then established exactly by weighing the individual sails which were cut from K&E Albanene cross-sectioned tracing paper of known weight. Final results were quoted as a percent of standard with the uncut sail and conventional mast and boom established as the standard.

The results of the wind tunnel power tests show the cambered mast system to be significantly more effective than the conventional systems at all wind headings with improvement being greater as the headings are moved closer to the wind, signifying a greater point capability.

The power measurements show another advantage of the cambermast in that heeling force is considerably less than that of the conventional systems. This can be attributed to the lack of a wake with its accompanying drag, and the fact that the geometry of the camber mast system repositions the center of effort more towards the center of a hull thereby giving inherent stability improvement for a boat in water.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or priviledge is claimed are defined as follows:

1. A sail rig having a mast pole and a boom,
means on said mast pole pivotally connecting it to a vehicle to rotate about an axis,
said mast pole having a vertically extending first part connected to said vehicle,
and a generally forwardly extending second part fixed to said first part,
said second part curving from a generally horizontally extending direction upwardly and terminating at a mast head,
a boom pivotally connected to said mast pole at the pivot axis thereof to swing about said axis,
a sail,
connecting means connecting said sail to said boom and to said mast pole,
said mast pole being tubular,
said connecting means comprising groove means in one side thereof extending continuously from the top to the bottom of the second part,
said sail having a bead thereon extending substantially the length of one side thereof slidably received in said groove.

2. The rig recited in claim 1 wherein means is provided for locking said mast in selected rotated positions.

3. The rig recited in claim 1 wherein said boom has a first part fixed to said mast pole and a second part hinged to the said rear end of said first part.

4. The rig recited in claim 1 wherein said boom is pivoted to said mast at the vertically extending port thereof.

5. The rig recited in claim 1 wherein said boom is hinged to said mast at the lower end of said second part.

6. The sailing rig recited in claim 1 wherein said curved part of said mast is curved sharply adjacent its base and curved more gently toward the mast head to control the boundary layer of air flowing over said mast,
and said boom is hinged to said mast at the lower end of said second part.

7. The rig recited in claim 1 wherein a handle is provided,
said handle being fixed at one end to said generally forwardly extending part of said mast and forming a continuation thereof.

8. The rig recited in claim 7 wherein said handle extends in a direction opposite said mast and curves downward and is attached to said mast.

* * * * *